United States Patent [19]

Miller

[11] 4,136,503

[45] Jan. 30, 1979

[54] ERROR-DETECTION SYSTEM FOR PACKAGING OF ARTICLES AND ENCODED CONTAINER BLANK THEREFOR

[75] Inventor: Douglas C. Miller, Richmond, Va.

[73] Assignee: Philip Morris Incorporated, New York, N.Y.

[21] Appl. No.: 789,218

[22] Filed: Apr. 20, 1977

[51] Int. Cl.[2] ..... B65B 57/06; B65B 57/18

[52] U.S. Cl. ..... 53/507; 53/493; 235/484; 340/146.3 Z

[58] Field of Search ..... 53/52, 53, 59 R, 78; 235/454, 462; 250/223; 340/146.3 Z

[56] References Cited

U.S. PATENT DOCUMENTS

| | | | |
|---|---|---|---|
| 3,035,380 | 5/1962 | Leavens | 53/78 X |
| 3,086,121 | 4/1963 | Cockrell | 235/454 |
| 3,152,256 | 10/1964 | Zuck et al. | 235/454 X |
| 3,609,306 | 9/1971 | Langley | 235/454 |
| 3,741,081 | 6/1973 | Lutz | 53/53 X |
| 3,794,812 | 2/1974 | Bryant | 340/146.3 Z |
| 3,803,967 | 4/1974 | Leavens | 53/78 X |

*Primary Examiner*—Robert Louis Spruill
*Attorney, Agent, or Firm*—Watson, Leavenworth, Kelton & Taggart

[57] ABSTRACT

A container blank is encoded on all flaps thereof in manner providing for presentation of the same coded pattern to a sensing unit irrespective of the flat registered with the sensing unit. The sensing unit is connected through article-designator apparatus to an indicating unit which is energized exclusively when the sensing unit indicates container blank article indication not conforming the article setting of the article-designator apparatus.

6 Claims, 4 Drawing Figures

ERROR-DETECTION SYSTEM FOR PACKAGING OF ARTICLES AND ENCODED CONTAINER BLANK THEREFOR

FIELD OF THE INVENTION

This invention relates generally to error-detection in the packaging of articles and more particularly to systems for assuring that articles are packaged in a container labelled in accordance therewith.

BACKGROUND OF THE INVENTION

In packaging articles, such as cigarettes, matching errors as between the article and its immediate container, a cigarette package, are eliminated by reason of total machineperformance of the packaging operation and the presence only of proper packaging components at the machine station. The same applies for the next successive packaging operation wherein cigarette packages are machine-assembled in labelled cartons. After this packaging juncture, extended human operator participation is introduced for economy in assembly of cartons in labelled shipping containers.

Typically, an operator works plural "bays", each day including a machine for arranging cartons in form for stack-insertion into a shipping container blank and for working the blank into sealed container configuration. A lift elevator places the stack in position whereby an operator may place an opened blank adjacent the stack for machine-controlled movement into containing relation therewith. The operator selects the container blank from plural labelled varieties at the bays, which varieties may number as many as eight per bay. Since the labelled containers issue from the bay apparatus in sealed condition, if selection is made of an erroneously labelled container blank, the error is not detectable until the container is opened at the purchaser's establishment. Evident supply problems may result for the purchaser.

SUMMARY OF THE INVENTION

It is an object of the present invention to detect matching errors as between articles and containers for assembly therewith.

A more specific object of the invention is to preclude machine-performed assembly of cigarette cartons and shipping containers not labelled in conformity with the cartons.

A further object of the invention is to provide encoded container blanks and practices for encoding thereof.

In attaining the above and other objects, the invention includes a code-sensing unit at a location adjacent the shipping container blank as it is opened and placed in position for stack insertion of cartons of articles therein. Uniquely coded information is preferably entered on all flaps of the container blank in such manner that the blank presents the same code pattern to the sensing unit, irrespective of which one of its flaps is in registry therewith. The sensor unit generates a light pattern and includes light-sensitive elements each viewing a subdivision of the sensor unit field of view. Circuitry processing output signals of the light-sensitive elements is settable in variably preselected manner and generates a control signal for interrupting assembly machine operation when the light-sensitive element output signals identify a container blank code pattern not identical with such setting of the processing circuitry.

The foregoing and other objects and features of the invention will be further evident from the following detailed description of the preferred embodiment of the invention and from the drawings wherein like reference numerals identify like parts throughout.

DESCRIPTION OF THE PREFERRED EMBODIMENT

Figure 1:
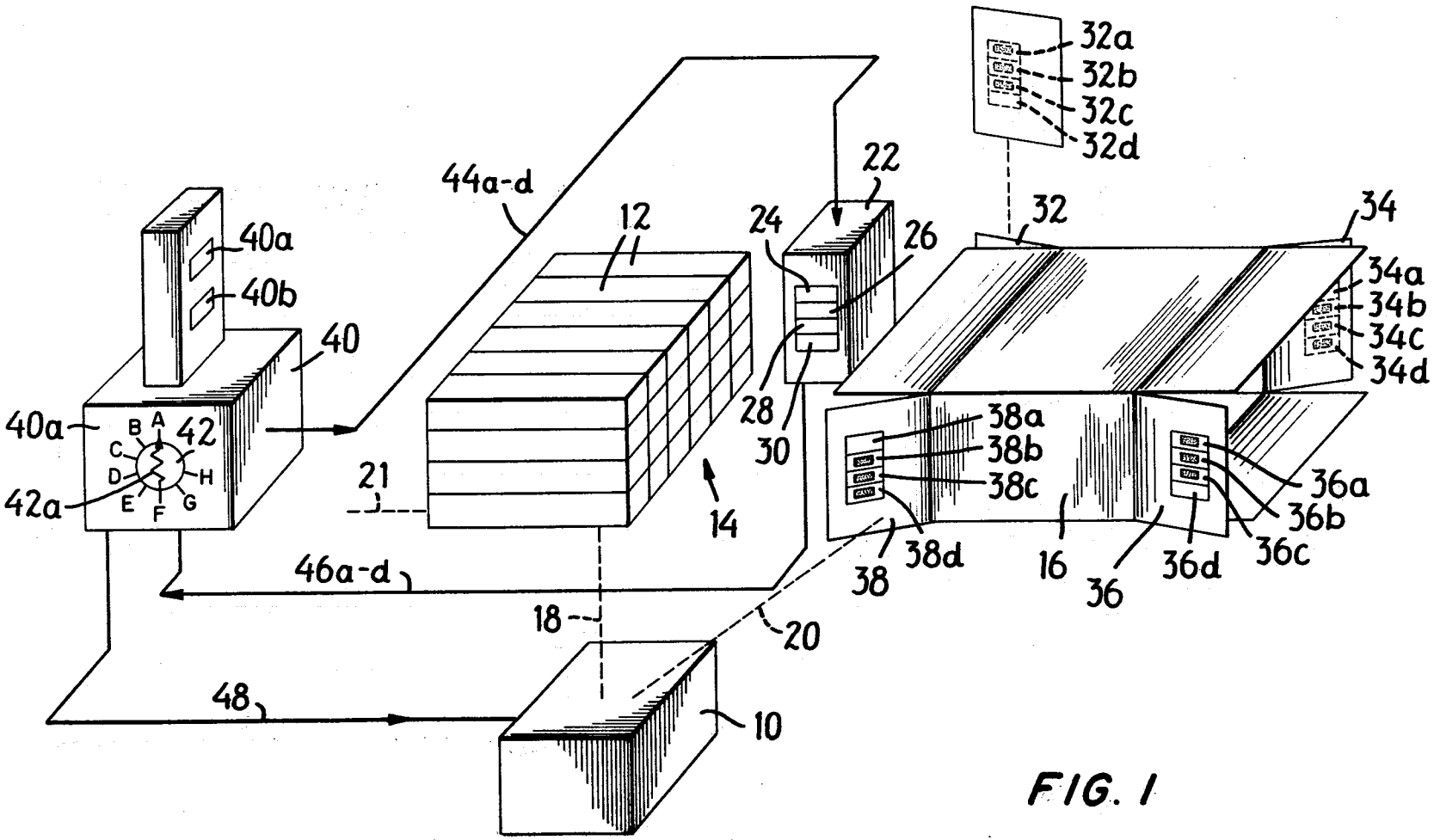
FIG. 1 is a schematic illustration of components involved in the error detection system of the invention and the case packer apparatus to which it is applied.

Referring to FIG. 1, reference numeral 10 identifies the control system of a commercially-used case packer, known as Standard Knapp No. 806 pneumatic packer, manufactured by Standard Knapp, a division of Emhart Corporation, Portland, Connecticut. Such packer is adapted to receive and assemble cigarette cartons 12 in the configuration of rectangular stack 14 and to lift the stack into position facing opened container blank 16. Mechanical line 18 is used to schematically indicate the lift mechanism of the case packer and line 20 to indicate the mechanism for engaging the container blank and for advancing it leftwardly to confront stack 14. The mechanism indicated by line 21 inserts the stack into the blank. Such mechanisms are well known and accordingly are not described in further detail.

Sensor unit 22 is shown disposed in FIG. 1 to the left of carton 12 for convenience in showing the sensor unit. In practice, the sensor unit is supported such that its active elements 24, 26, 28 and 30 register respectively with encodable areas 32*a*, 32*b*, 32*c* and 32*d* of blank side flap 32 when the container blank is engaged by the blank engaging and advancing mechanism indicated by line 20.

In accordance with the invention, each container blank has its side flaps 32, 34, 36 and 38 encoded such that the operator may open the blank and apply it to the case packer with any side flap in facing relation to sensor unit 22 and yet present the single article-identifying code for the applied blank to the sensor unit. Flap 34 has encodable areas 34*a*, 34*b*, 34*c* and 34*d*, flap 36 has encodable areas 36*a*, 36*b*, 36*c* and 36*d* and flap 38 has encodable areas 38*a*, 38*b*, 38*c* and 38*d*. The areas are painted flat black (code zero) or are unpainted (code one), or are otherwise prepared to evidence such sensible distinction from one another. For the illustrated container blank, flap 32 exhibits the code 0001 (pattern I, FIG. 4) in areas 32*a* through 32*d*, respectively. Areas 34*a* through 34*d* exhibit the code 1000 in FIG. 1, which will appear as 0001 if the container blank is arranged with flap 34 in registry with sensor unit 22. Diagonally opposite flaps, e.g., flaps 32 and 36 or flaps 34 and 38, will be seen to exhibit the same code. The codes of flaps on the same container side differ from one another.

Control unit 40 of FIG. 1 includes rotational position identifiers A through H on front face 40*a* arranged circularly about a central opening in which key-operated cylinder unit 42 is supported for rotation. In practice, a key (not shown) or other security safeguarding operator is inserted in key opening 42*a*, whereupon the arrowed indicator on unit 42 may be set, in accordance with the type of article being packaged, coincidently with the corresponding one of the rotational position identifiers. By components discussed hereinafter, unit 40 generates on lines 44*a* through 44*d* signals for excitation of lamps of elements 24–28 and sets its detector circuitry in accordance with the angular position of key opening 42*a*. Light-sensitive detectors of elements 24–28 are selectively energized by interfacing of such lamps and the container blank code pattern and accordingly generate signals on lines 46*a* through 46*d* which are returned to unit 40. Where such line 46*a*–46*d* signals are not in accord with the detector circuitry as set by angular setting of key-operated unit 42, control unit 40 applies a signal to line 48 which in turn directs discontinuance of operation of system 10 by supplemental circuitry introduced therein, as discussed below. Additionally or alternatively, control unit 40 energizes error display lamp 40*a* (red) and extinguishes proper match lamp 40*b* (green), further alerting the operator to the mismatch.

Figure 2:
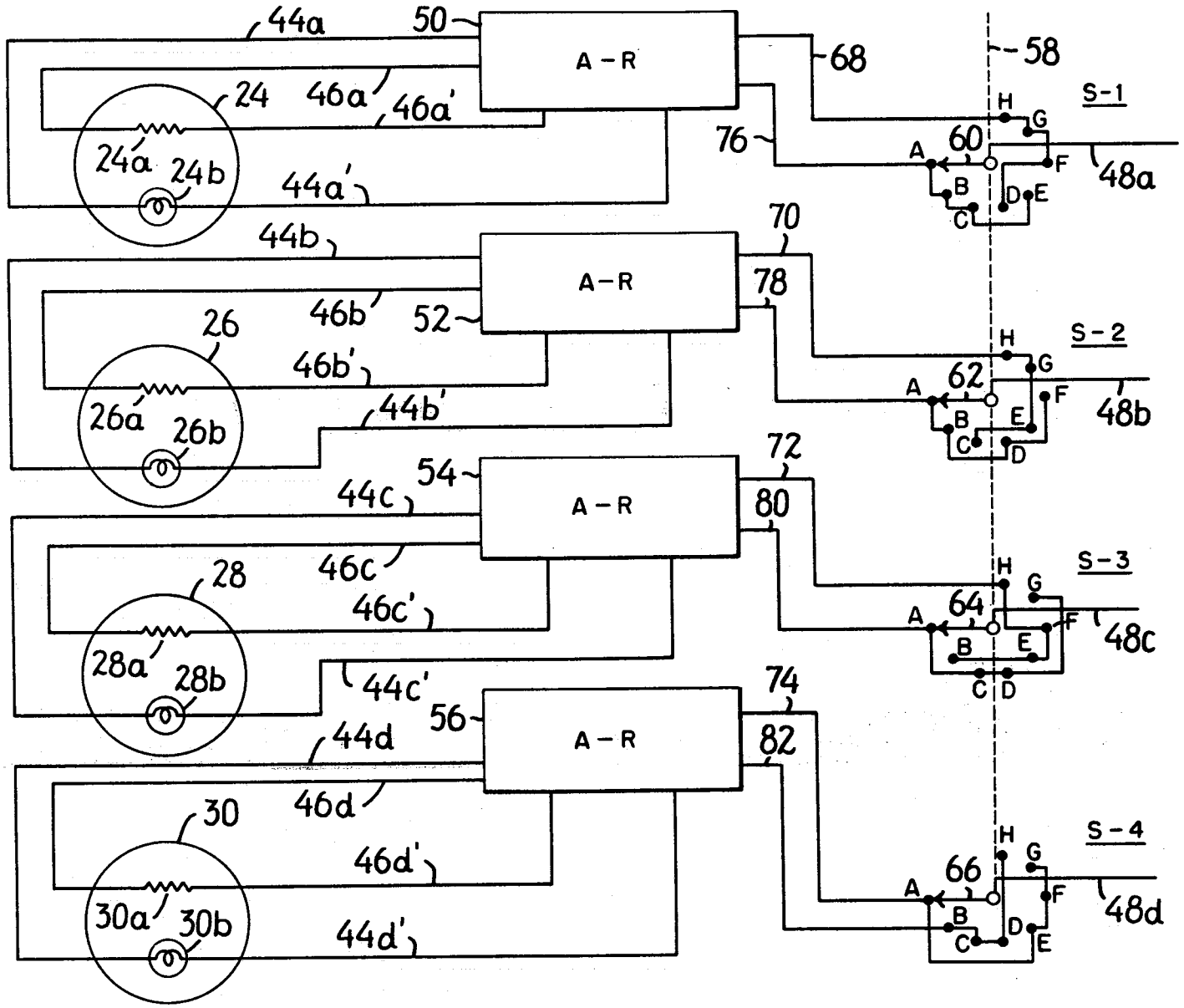
FIG. 2 is an electrical schematic diagram showing components of sensor unit 22 and control unit 40 of FIG. 1.

Referring to FIG. 2, control unit 40 to FIG. 1 includes amplifier-relay (A-R) units 50, 52, 54 and 56, each of which may comprise a commercially-available circuit component discussed below. A-R 50 is connected to sensor unit element 24 with photoresistor 24*a* being series-connected between lines 46*a* and 46*a'* and lamp 24*b* being series-connected between lines 44*a* and 44*a'*. As indicated by lines 44*b* through line 46*d'*, like circuit connections are made between A-R 52 and photoresistor 26*a* and lamp 26*b* of sensor unit element 26, between A-R 54 and photoresistor 28*a* and lamp 28*b* of sensor unit element 28 and between A-R 56 and photoresistor 30*a* and lamp 30*b* of sensor unit element 30.

Key-operated cylinder unit 42 of FIG. 1 is mechanically connected to shaft 58 which is in turn fixedly connected to movable contacts 60, 62, 64 and 66 of rotary switch sections S-1, S-2, S-3 and S-4. The switch sections have stationary contacts in positional registration as indicated with identifiers A through H of unit 40 (FIG. 1). In the position indicated for the movable contacts, all thereof engage contacts in position A of the switch sections. Certain stationary contacts of the switch sections are connected to the A-R units by first lines 68, 70, 72 and 74. Thus, contacts of S-1 in positions D, F, G and H are directly connected to line 68. Second lines 76, 78, 80 and 82 interconnect the A-R units with other stationary contacts of the switch sections. Thus, contacts of S-1 in positions A, B, C and E are connected to A-R 50 by line 76. Movable contacts 60, 62, 64 and 66 are connected respectively to lines 48*a*, 48*b*, 48*c* and 48*d*.

Figure 3:
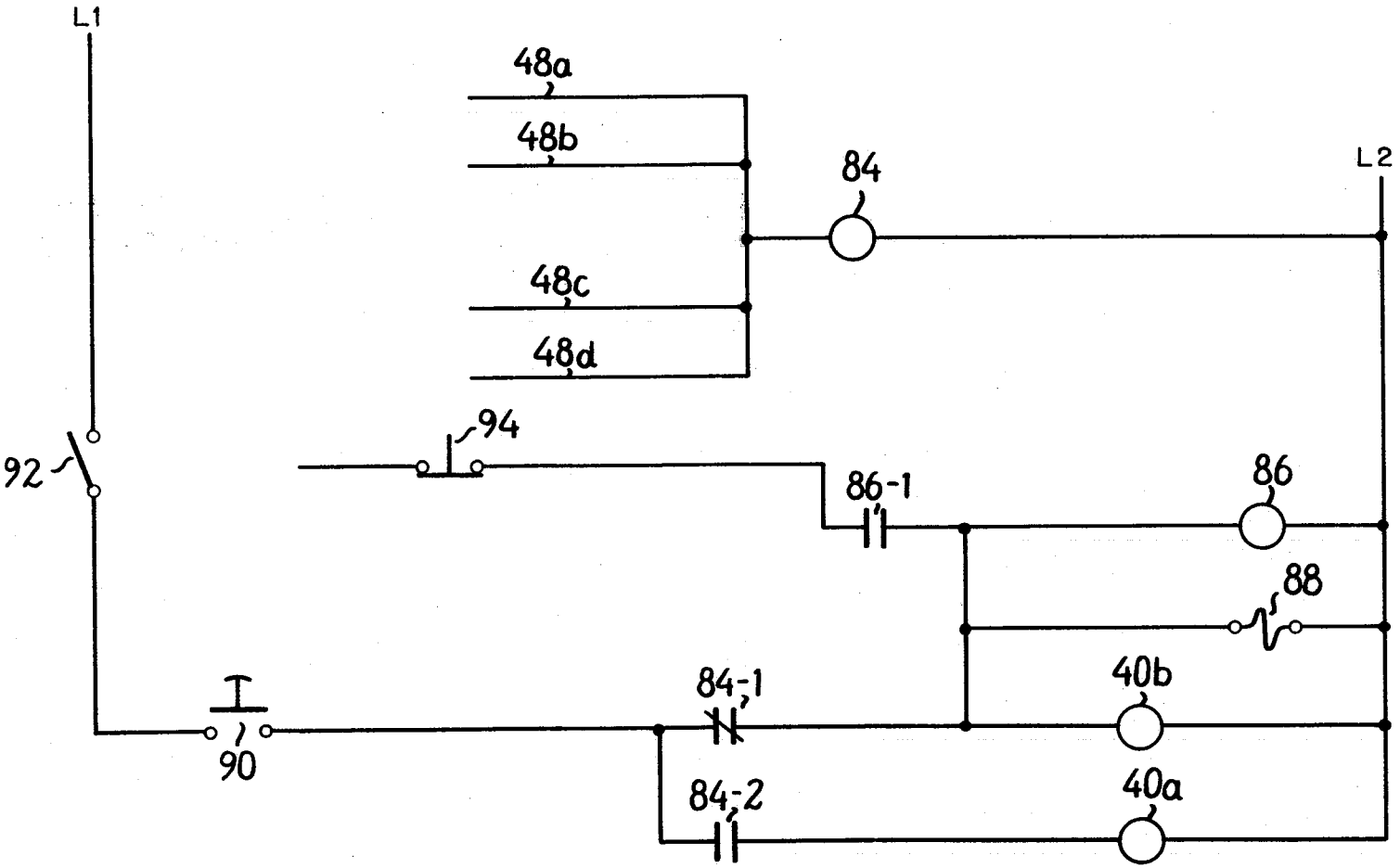
FIG. 3 is an electrical schematic diagram illustrating circuit modifications introduced in accordance with the invention in case packer control system 10 in FIG. 1.

Turning to FIG. 3, lines 48*a–d* are connected in common to the coil of relay 84. In accordance with the invention, relay 84 is introduced in case packer system 10 (FIG. 1), with its relay contacts 84-1 (normally closed) and 84-2 (normally open). Contacts 84-1 are introduced in series circuit with both relay 86 and solenoid 88 of system 10 which comprise the drop-off relay and solenoid of such known system. Lamp 40*b* is also seriesconnected with contacts 84-1. Lamp 40*a* is series-connected with contacts 84-2. Push button switch 90 (drop off-up), packer system off-on switch 92 and switch 94 (drop off-down) are counterparts of the known packer control system. Power mains providing suitable voltage for operation of the components are fused and switch-connected, by conventional means not shown, to lines L1 and L2.

A preferred circuit embodiment for A-R units 50, 52, 54 and 56 is Plug-In Photoelectric Control Model PI, manufactured by Scanning Devices, Cambridge, Massachusetts. In use of this commercially-available unit, for example for A-R 50, manufacturerdesignated (m-d) terminals one and six are connected through an on-off switch (not shown) to L1 of FIG. 3, m-d terminal two is connected to L2, m-d terminal three to line 44*a* (FIG. 2), m-d terminal four to line 44*a'*, m-d terminal ten to line 46*a'*, m-d terminal eleven to line 46*a*, m-d terminal eight to m-d terminal nine, m-d terminal five to line 76 and m-d terminal seven to line 68. The A-R units are effective as detectors, being comprised of an input amplifier section and an output relay section. The amplifier is responsive, in the case of A-R 50, to lines 44*a* and 44*a'* to selectively energize the relay section. Normally-open relay contacts are in series circuit with line 76 and normally-closed relay contacts are in series circuit with line 68.

Elements 24–30 preferably each comprise Single Unit Photoelectric Scanner Model S-3, manufactured also by Scanning Devices.

A-R unit 50 continually energizes lamp 24*b* from lines L1 and L2 and is dark-operated, i.e., provides a line 68 HI (connects first line 68 to energizing voltage L1), when its associated photoresistor 24*a* is not illuminated. Conversely, when associated photoresistor 24*a* is illuminated by lamp 24*b* light reflected thereto from an unpainted flap area of the container blank, A-R 50 sets line 76 HI (connects second line 76 to L1).

The other A-R units 52, 54 and 56 are connected in like manner set forth for A-R unit 50. Thus, if all A-R units are operated (photoresistors not illuminated), first lines 68, 70, 72 and 74 would be HI (connected to L1), and second lines 76, 78, 80 and 82 would be LO (connected to L2).

Figure 4:
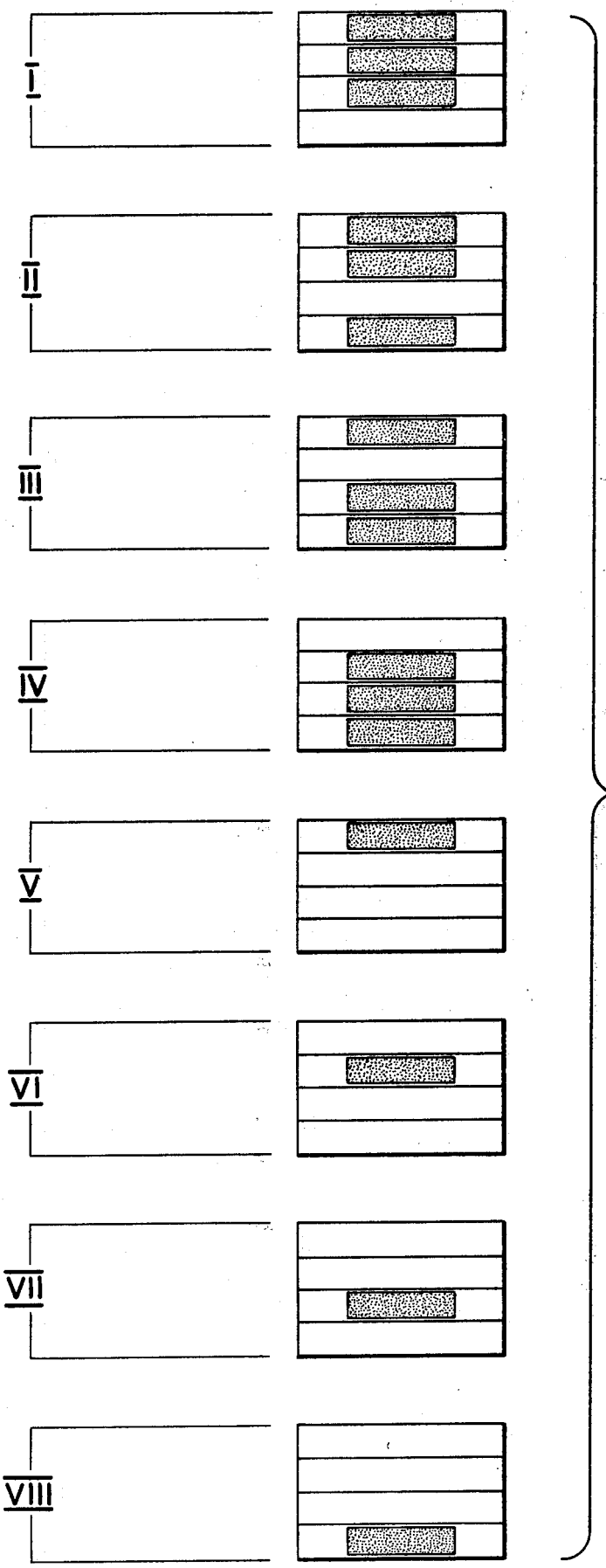
FIG. 4 depicts coded container patterns for use in practicing the invention.

The selection of connections of contacts of switch sections S-1 through S-4 to lines 68–82, shown in FIG. 2, is coordinated with the code patterns shown in FIG. 4 to provide for energization of relay 84 (FIG. 4) only upon operator selection of a container blank whose article-indicating code differs from the article selection designation of unit 42.

The following container blank codes (FIG. 4) apply for positions of key cylinder 42.

| Position | Code | |
|---|---|---|
| A | 0001 | (I) |
| B | 0010 | (II) |
| C | 0100 | (III) |
| D | 1000 | (IV) |
| E | 0111 | (V) |
| F | 1011 | (VI) |
| G | 1101 | (VII) |
| H | 1110 | (VIII) |

For position A, lines 68, 70 and 72 are all HI when container blank code I is presented by the container blank since A-R units 50, 52 and 54 are unoperated. These lines are isolated from lines 48*a*, 48*b* and 48*c* since contacts 60, 62 and 64 are not connected with the lines. On the other hand, lines 76, 78 and 80, all LO under code I conditions are connected through contacts 60, 62 and 64 to lines 48*a*, 48*b* and 48*c*. For code I, line 74 is LO and line 82 is HI, since A-R unit 56 is operated by the pattern 0001. However, the A-positioned stationary contact of switch section S-4 is connected to line 74

(LO) and line 48*d* accordingly receives a LO from contact 66. Thus, none of lines 48*a*–48*d* is HI when position A and code I are jointly involved. As will be seen, however, if any container blank code other than code I is presented to sensor unit 22 with the multi-sectioned switch S1-S4 in position A, one of lines 48*a*–48*d* will be HI and operation of the packer system will be interrupted by energization of relay 84. By way of example, let it be assumed that an operator selects a container blank having code VI in FIG. 4, i.e., 1011. On this occurrence, A-R units 50, 54 and 56 will be unoperated and A-R unit 52 operated. Lines 76, 70, 80 and 82 will then be HI. Lines 48*a* and 48*c* are accordingly HI and relay 84 is energized.

As can be determined by examination of the states of energization and non-energization of lines 68–82 for code patterns I-VIII and connections thereof to lines 48*a*–48*d* for the various settings of switch sections S1-S4, one or more of lines 48*a*–48*d* is energized whenever the article setting and container code are not A and I, B and II, C and III, D and IV, E and V, F and VI, G and VII and H and VIII, respectively.

As will be seen from the position-code tabulation above and from FIG. 4, preferred practice under the invention employs a four-bar code comprising every other available code which is available from the four-bits. Thus, the conventional binary progression from code I (0001) would be to code 0011. This code is skipped (not used) and the next successive pattern (0010) is used as code II. By this practice, the system of the invention precludes the possibility of an actual mismatch going undetected by reason of failure of one of the A-R units or associated lamps and photoresistors. For example, assume lamp 28*b* (FIG. 2) to have burned out, the article setting to be A and a container blank having code II to have been selected. With lamp 28*b* inoperative, A-R units 50, 52 and 54 will be operated, as in the above-discussed example for a blank having code I. However, A-R unit 56 will now be operated, providing output indication of mismatch. If the code 0011 has been used, mismatch would go undetected, since A-R units 50, 52 and 54 would be operated and A-R unit 56 unoperated, as in the code I situation, and no output indication would be provided.

In use of the error detection system in its foregoing application, selection is made of the type of carton cigarettes which are to be supplied to the case packer over, for example, a shift of plant operation. Unit 42 is key-operated to be set to such type of carton cigarettes. As noted above, as many as eight differently-labelled container blands are present at the given bay. Should the operator select an erroneous container blank, the error detection system will arrest operation of the case packer as the erroneous container blank is placed in registry with sensor unit 22. In use of the Knapp packer, the operator depresses the push button of switch 90 (FIG. 3) after placing the container blank in registry with the sensor unit. If relay 84 is not energized (no mismatch), energizing current is supplied momentarily through switch 90 and contacts 84-1 to energize drop off relay 86. Latching contacts 86-1 are thereupon closed and energizing current is supplied through switch 94 and contacts 86-1 to solenoid 88 and relay 86. An arm member thereupon moves upwardly into sustaining engagement with the container blank and trips a limit switch initiating the further operating cycle of the packer. On completion thereof, switch 94 is operated, deenergizing relay 86 and solenoid 88 whereupon the arm member drops in readiness for the next packer cycle. If relay 84 is energized (mismatch), the arm member does not move upwardly and the foregoing packer cycle does not take place.

By way of summary of the error detection system, output indication of mismatch is provided, visually as by indicators 40*a* and 40*b* and otherwise by energization of relay 84, responsively to application to one or more of lines 48*a*–48*d* of energizing voltage of predetermined character, e.g., the HI voltage of line L1. Sensor circuitry, inclusive of sensor unit 22 and the A-R circuits of FIG. 2 examines container blanks and generates voltages of character inclusive of the character of such energizing voltage and other character, e.g., the LO voltage of line L2, the pattern so generated being unique for each container blank. Article-designator apparatus, such as the switch constituted by switch sections S1-S4 and a key or the like therefor, is settable differently for each article and defines such paths therethrough for the voltages generated by the sensor circuitry that indicator apparatus receives energizing voltage only when the voltage pattern generated by the sensor circuitry is indicative of a container having article designation diverse from the article designation of the article designator apparatus.

In its preferred illustrated embodiment, the article designator apparatus is arranged in series circuit with the sensor circuitry and the indicator apparatus and interconnects the same. Such arrangement eliminates need for customary comparison circuitry of type comparing plural inputs to determine correlation therebetween. Evidently, such comparison circuitry may be used in practicing the subject invention where the article designator apparatus is of type different from that illustrated herein. This and other circuit modifications may be employed without departing from the invention. Thus, the particularly described and discussed embodiment is intended in an illustrative and not in a limiting sense. The true spirit and scope of the inveniton is set forth in the following claims.

What is claimed is:

1. A system for providing output indication of matching errors as between diverse articles and containers for assembly therewith and bearing plural bit article designation, comprising:

(a) indicator means providing said output indication upon application thereto of an energizing voltage of predetermined character;

(b) sensor circuit means for simultaneously examining such designation bits and generating voltages of character inclusive of that of said energizing voltage and other character in a pattern unique for each such examined container and indicative of the article designation thereof; and (c) article-designator means comprising variably-settable switch means for each said designation bit series-connected between said sensor circuit means and said indicator means, said article-designator means being settable for each of said articles by single common input to all said switch means to supply such energizing voltage generated by said sensor circuit means to said indicator means exclusively when the voltage pattern generated by said sensor circuit means is indicative of a container having article designation diverse from such article-setting of said article-designator means.

2. The system claimed in claim 1 wherein said sensor circuit means includes a plurality of sensing elements and a plurality of output lines for collectively providing such voltage patterns unique for each examined container and wherein said switch means is a plural section switch, each section thereof having stationary and movable contacts, said stationary contacts being connected to said output lines and said movable contacts being connected to said indicator apparatus.

3. The system claimed in claim 2 wherein said sensor circuit means output lines are provided in a pair for each said sensing element and each such output line pair is connected to the stationary contacts of a distinct section of said switch means.

4. The system claimed in claim 1 wherein said indicator means includes circuit means for arresting such assembly of said containers with said articles to provide said output indication.

5. The system claimed in claim 4 wherein said indicator means further includes means for providing visual output indication of such matching error.

6. In combination, the system claimed in claim 1 and containers bearing respectively different plural bit article designations following a binary progression with only alternate steps in the progression being employed.

* * * * *

UNITED STATES PATENT AND TRADEMARK OFFICE

CERTIFICATE OF CORRECTION

PATENT NO. : 4,136,503

DATED : January 30, 1979

INVENTOR(S) : Douglas C. Miller

It is certified that error appears in the above-identified patent and that said Letters Patent are hereby corrected as shown below:

At Col. 1, line 16 "machineperformance" should read --machine-performance--.

At Col. 3, line 24, "to FIG. 1" should read --of FIG. 1--.

At Col. 3, line 63, "seriesconnected" should read --series-connected--.

At Col. 4, line 7, "manufacturerdesignated" should read --manufacturer-designated--.

At Col. 5, line 51, "blands are present" should read --blanks are present--.

Signed and Sealed this

*Eighteenth* Day of *December 1979*

[SEAL]

*Attest:*

SIDNEY A. DIAMOND

*Attesting Officer*

*Commissioner of Patents and Trademarks*